United States Patent [19]

Wojtowicz

[11] Patent Number: 4,593,290

[45] Date of Patent: Jun. 3, 1986

[54] COLLAPSIBLE ANTENNA ASSEMBLY

[75] Inventor: Edward A. Wojtowicz, Bryn Mawr, Pa.

[73] Assignee: System Development Corporation, Camarillo, Calif.

[21] Appl. No.: 585,501

[22] Filed: Mar. 2, 1984

[51] Int. Cl.[4] ..... H01Q 1/34; H01Q 1/08

[52] U.S. Cl. ..... 343/900; 343/709

[58] Field of Search ..... 343/709, 710, 715, 900

[56] References Cited

U.S. PATENT DOCUMENTS

| | | | |
|---|---|---|---|
| 4,376,939 | 3/1983 | Reid | 343/900 |
| 4,477,818 | 10/1984 | Malvick | 343/709 |
| 4,494,123 | 1/1985 | Moore et al. | 343/900 |

*Primary Examiner*—Eli Lieberman

*Attorney, Agent, or Firm*—Francis A. Varallo; Mervyn L. Young; Kevin R. Peterson

[57] ABSTRACT

The present disclosure describes an antenna which may be collapsed and stored in a compact configuration and readily released from storage to assume a deployed operative state. More specifically, the antenna is a wire member comprised of a straight section and an integral transverse helical spring section. The antenna lends itself to storage about the axis of a right circular cylinder while permitting full deployment parallel to the longitudinal axis of the latter. This arrangement permits the storage of potential energies of torsion and bending respectively in the helical spring and straight portions of the antenna, and permits continuous motion in these planes to effect antenna erection and deployment.

12 Claims, 3 Drawing Figures

COLLAPSIBLE ANTENNA ASSEMBLY

BACKGROUND OF THE INVENTION

Applications exist for an antenna for transmitting electrical signals wherein the antenna is preferably stored in a collapsed, compact configuration and released or extended to an operational state when desired. For example, such applications might include emergency locator beacons or communication satellites. Still another application involves sonobuoys. The latter are devices equipped with hydrophones for detecting underwater sounds and a radio for transmitting them via an appropriate antenna to a remote receiver. Large numbers of such sonobuoys, which in an actual operative environment, are comprised of cylindrical enclosures, may be launched by aircraft over the area to be monitored.

It is apparent that the space allotment in the shipping and launch containers carried by the aircraft is limited. At the same time, economy dictates that the largest number of sonobuoys be stored in such containers for subsequent deployment. Moreover, since the optimum length of the sonobuoy transmitting antenna is considerably greater than the longitudinal dimensions of the sonobuoy container, it is impractical to mount the antenna within the container. Likewise, the storage of sonobuoys with respective external antennas deployed for transmission such that the antenna axes are parallel to the longitudinal axes of the containers, is precluded by space limitations.

In addition to the advantage of using small sonobuoy containers to maximize the numbers of the latter which may be stored and launched at one time, another advantage unique to this application is realized. Reduction in the length of the sonobuoy container significantly reduces the total weight of the device. In free-fall situations, where deceleration means such as parachutes, are not utilized to provide cost savings, the impact velocity of the sonobuoy with the water is a function of its weight. Thus, the shorter container length reduces terminal impact velocity, thereby yielding improved impact survivability.

What is required to achieve the foregoing advantages is a collapsible external antenna of substantially optimum transmission efficiency, which may be stored within the envelope generated by the sonobuoy container, and which is readily erected when the sonobuoy is deployed in its operative environment. The antenna of the present invention fulfills all of the foregoing requirements and while it is admirably suited for the sonobuoy application, the invention should not be considered as limited thereto.

SUMMARY OF THE INVENTION

In accordance with the present invention, an antenna assembly is provided which is comprised of the wire antenna itself and the structure for storing and erecting the antenna which is formed into the sonobuoy container or housing.

The antenna of an actual operative embodiment is fabricated from a single piece of spring steel wire. One extremity of the latter is fashioned into a helical spring and integral therewith, there is provided transverse thereto, a straight section of predetermined length, suitable for the particular application. The sonobuoy housing which may be a cylindrical injection molded plastic container, includes in proximity to one extremity thereof, a circumferential slot for storing the straight length of the antenna, a small cylindrical molded mounting projection for receiving the helical spring portion of the antenna, and a molded vertical antenna erection cam. A vertical detent slot is provided to maintain the antenna in a stable vertical orientation after its erection.

Storage of the antenna is accomplished by placing its helical spring section over the cylindrical mounting projection. The end of the latter section is then made to enter the interior of the sonobuoy through a small aperture in its wall structure. The straight antenna section is then oriented in a generally vertical sense, that is, parallel to the longitudinal axis of the sonobuoy, but including a slight angularity in the direction of the detent wall which it will ultimately contact when erected after storage.

In order to store a torsional preload into the helical spring section of the antenna to insure such erection, the straight section of the antenna is rotated in a direction which tends to wind the helical coils tighter. Rotation of the straight section continues until the latter assumes a horizontal orientation, that is, transverse to the longitudinal axis of the sonobuoy. At this point the straight section lies adjacent the uppermost portion of the circumferential slot. The straight antenna section is then bent by being wrapped helically around the body of the sonobuoy within the slot. Energy storage is now engendered in the straight section through the aforementioned bending action along the periphery of the slot. If the straight section is longer than the circumference of the slot, the section is routed over the end of the helical spring section via a groove in the mounting projection. The end of the straight antenna section is then restrained within the circumferential storage slot by containment means, such as a slidably mounted pullrod.

To release the antenna, the containment means is actuated. The straight section of the antenna is accelerated in an unravelling fashion. The latter action proceeds until the straight section reaches the base of the erection cam formed in the sonobuoy housing. At this point, involute unravelling of the straight antenna section is abruptly terminated and motion is redirected vertically by the action of the erection cam profile. The antenna exits the circumferential storage slot and enters the vertical detent slot, as effected by the torsional energy stored in the helical spring section, and the diverting action of the erection cam. Finally, the antenna contacts the internal detent wall, at which point, the antenna is fully deployed and has its axis parallel to the longitudinal axis of the sonobuoy housing.

Other features and advantages of the antenna assembly of the present invention will become apparent in the detailed description which follows.

DESCRIPTION OF THE PREFERRED EMBODIMENT

Figure 1:
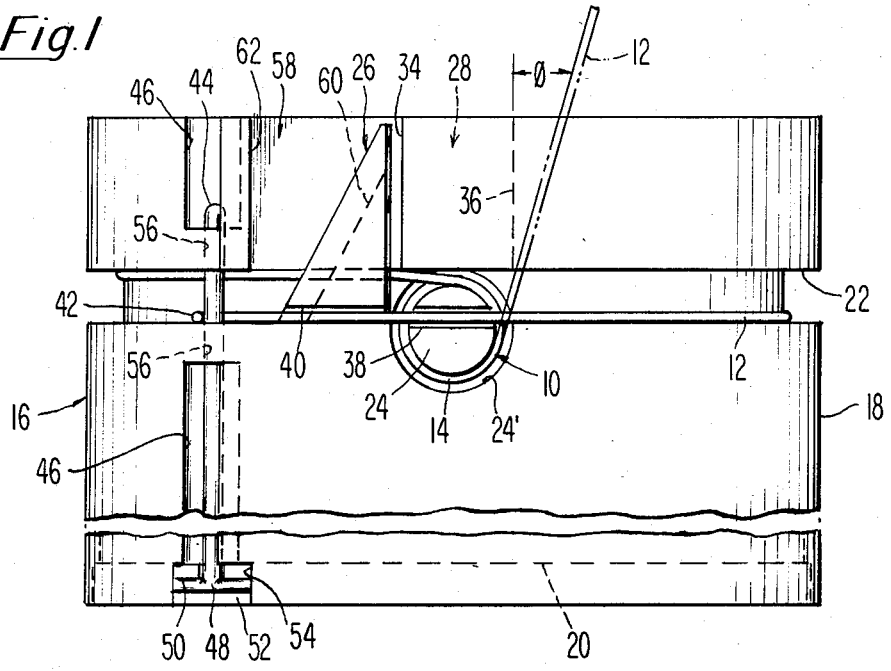
FIG. 1 is a front view of the antenna assembly of the present invention illustrating the attainment of its collapsed stored state in a sonobuoy housing.
Figure 2:
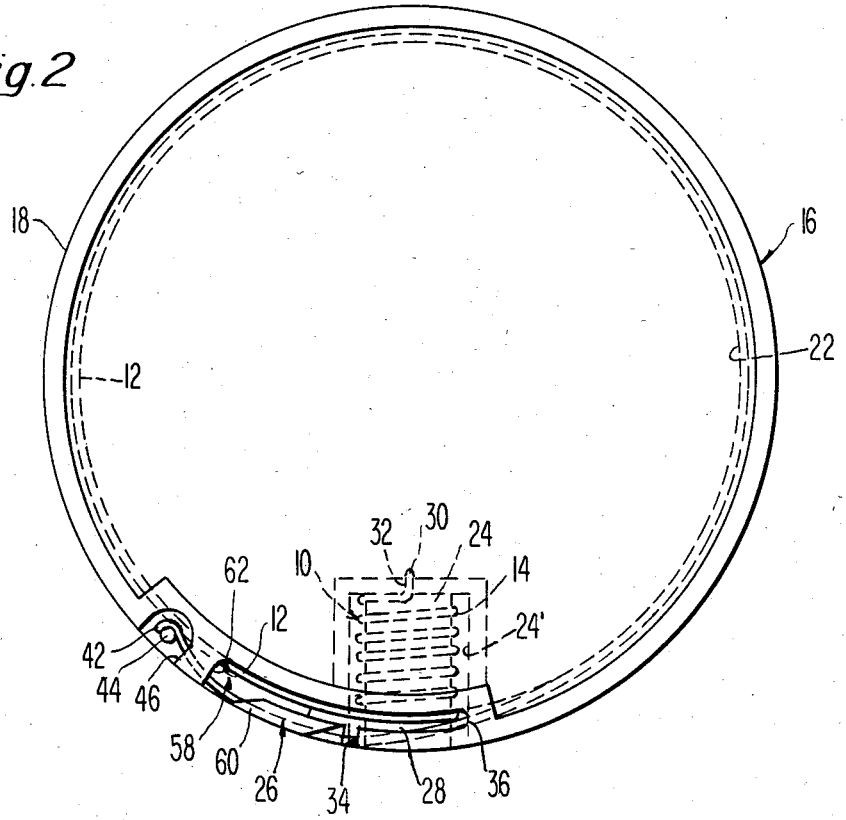
FIG. 2 is a plan view of the sonobuoy housing of FIG. 1 showing particularly the helical section of the antenna.
Figure 3:
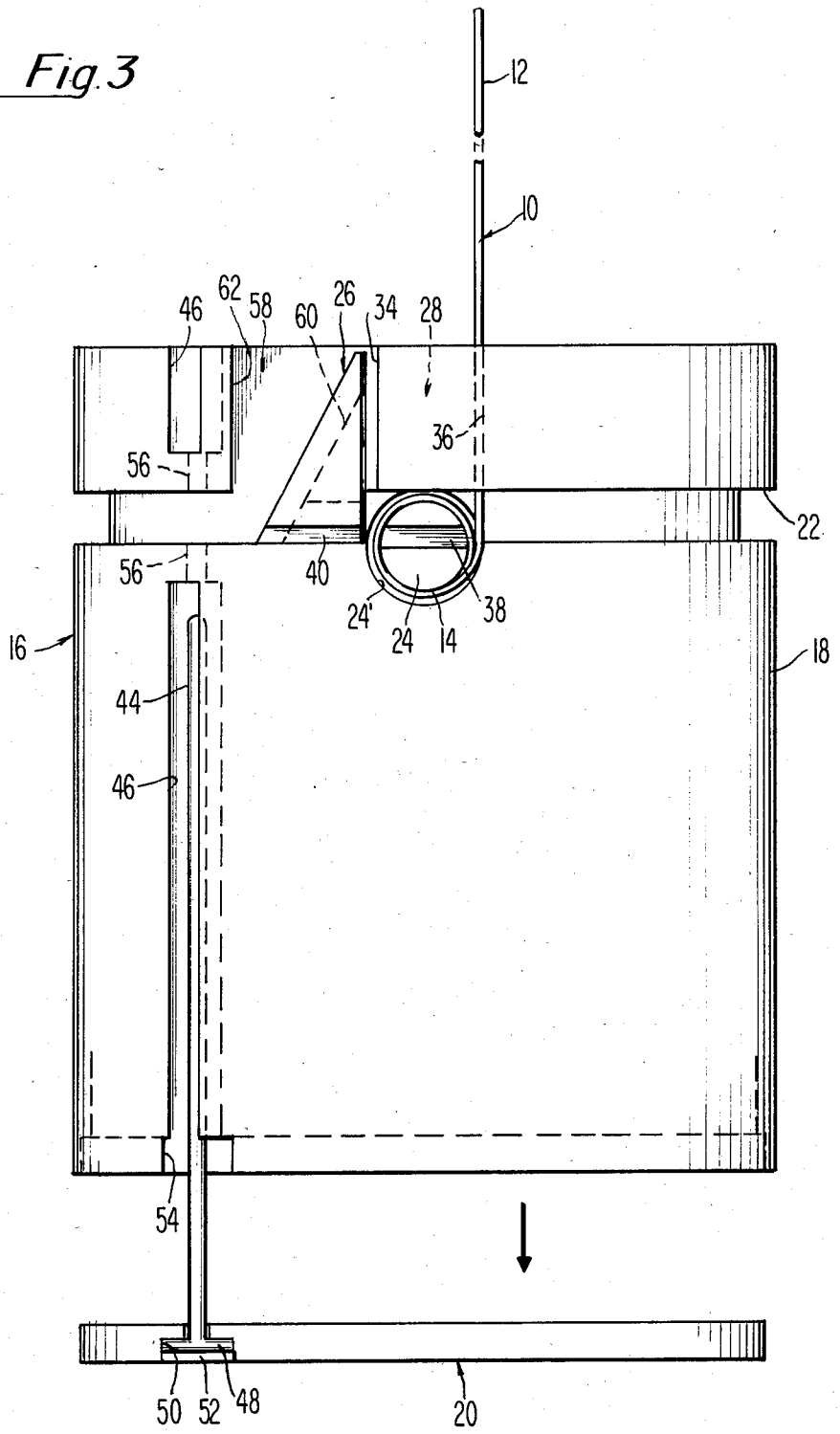
FIG. 3 is an erected front view of the antenna assembly indicating attainment of its deployed state.

With reference to the front view of FIG. 1 and the corresponding plan view of FIG. 2, the antenna 10, preferably formed of spring wire, is comprised of a helical section 12 and a straight section 14, that is, straight when erected (FIG. 3). The coil axis of the helical section 12 and the longitudinal axis of straight section 14 are disposed transversely and the latter is tangential to the coil diameter. The antenna 10 is shown collapsed and stored in a simplified sonobuoy housing 16, having an upper portion 18 and a lower cap portion 20.

The upper portion 18 of housing 16 includes a circumferential storage slot 22 for receiving the straight section 12 of antenna 10; a small cylindrical molded mounting projection 24 disposed within a cavity 24'; a molded vertical antenna erection cam 26; and a vertical detent slot 28.

With continued reference to FIGS. 1 and 2, the collapse and storage of the antenna 10 is accomplished as follows. The helical spring section 14 of the antenna 10 is placed over the cylindrical projection 24 within cavity 24' in housing 16, such that the end 30 of the spring is inserted through a small hole 32 in the housing wall and accesses the internal portion of the housing 16. This permits the antenna 10 to be anchored for energy storage as will be described hereinafter, as well as permitting an electrical connection to a device, such as a radio transmitter (not shown) disposed within the housing 16. The opening 32 may then be sealed with any suitable substance, for example, an epoxy potting compound.

Next, the straight section 12 of the antenna 10, shown in phantom, is bent for routing through the vertical assembly slot 34, adjacent to the erection cam projection 26 and leading into the vertical detent slot 28. As indicated, the orientation of the straight section 12 at the time of mounting of the helical section 14 over the mounting projection 24 is generally vertical. However, a slight angularity, designated as angle $\phi$, is introduced with respect to the erected position of the antenna in contact with the internal detent wall 36. This small preload aids in maintaining the erect antenna position.

To implement the vertical erection, a torsional preload must be engendered into the helical section 14 of the antenna. This is accomplished by rotating the straight section 12 in a direction to wind the coils of the helical section 14 tighter. Rotation continues until antenna section 12 is moved from its vertically disposed, free state, unpreloaded angularity to a horizontal orientation, transverse to the longitudinal axis of the housing 16. The straight section 12 is now coincident with the uppermost portion of the circumferential storage slot 22. It is then bent and wrapped within the slot 22. As the straight section 12 completes one revolution, it is routed past mounting projection 24 via groove 38 therein, and erection cam 26 via groove 40 in its outer surface. The end of the straight antenna section 12 is formed into a tang 42, and at the point where it comes to rest within circumferential slot 22, a containment means is provided. As shown in FIGS. 1 and 2, the latter is conveniently provided by a pullrod 44, slidably disposed within a longitudinal slot 46 in the periphery of the housing 16. One extremity 48 of the pullrod 44 is formed as a "T" and is loosely disposed within a slot 50 in the lower cap portion 20 of housing 16. A projection 52 in the lower cap 20 supports the pullrod 44 and aligns it by virtue of its disposition in a cutout 54 formed in the wall of the upper housing 18. The foregoing structure assures that the pullrod 44 lies within the housing envelope. Containment holes 56 are provided in the housing 18 on respective opposite sides of the circumferential storage slot 22 for receiving the opposite extremity of the pullrod 44, at the point where it engages the antenna tang 42. The pullrod 44 resists the radially directed forces exerted thereon by the deformed straight section 12 of the antenna.

With continued general reference to FIGS. 1 and 2 and more specific reference to FIG. 3, antenna erection is implemented as follows. Upon the launch of the sonobuoy housing 16, the lower cap portion 20, as well as the pullrod 44, are jettisoned in the direction of the arrow. This action forces the pullrod 44 out of the containment holes 56 in the upper portion 18 of the housing. The straight section 12 of the antenna 10 is immediately released, and accelerates in an unravelling fashion. The unravelling process proceeds until the straight section 12 reaches the base of the erection cam 26. At this point, involute unravelling is abruptly terminated and motion is immediately redirected from horizontal (transverse to the housing longitudinal axis) to vertical (along the latter axis) through the action of the profile of the erection cam 26. The straight antenna section 12 exits the storage slot 22 and enters the vertical detent slot 28 via its entrance opening 58. The detent slot 28 is molded as a circular sector which extends in a longitudinal direction to the base of the storage slot 22, for the full sector length. Detent slot 28 maintains the antenna in a stable vertical position.

The erection of the antenna to a vertical orientation is effected by the torsional energy stored in the helical spring portion thereof. More specifically, the straight antenna section 12 is directed by the forces in the helical spring 14 against the erection cam 26 and motion takes place vertically. The ramp section 60 of the erection cam 26 is cut at a compound angle, inward toward the detent slot 28 in order to aid in the antenna transition from horizontal to vertical. The width of the entrance opening 58 is chosen so as not to inhibit vertical antenna motion. Since the entrance opening 58 is located on the circular periphery of the upper housing 18, a tangent position of the antenna upon entering the opening will preclude its collision with the entrance wall 62.

In conclusion, there has been described an antenna assembly in which an antenna of significantly greater length than its supporting member, is collapsed and stored within the profile of the latter. Moreover, the antenna may be easily erected through the release of stored potential energies without expending electrical power. As noted hereinbefore, although the antenna assembly has been described for use in sonobuoys, the invention is not to be construed as limited thereto. Diverse applications may advantageously use the assembly taught herein. Depending upon the application, changes and modifications of the assembly may be required. For example, the optimum length of the straight section of the antenna is a function of the frequency of transmission—a length of 19.56 inches, corresponding to $\frac{1}{4}$ of the wavelength at a midrange frequency of 150 Mhz. The diameter of the antenna wire must be selected with regard to the circumference of the storage slot in order that it will not be overstressed in its stored state and will be capable of resuming a straight condition upon deployment. The energy storage properties of the antenna sections may be enhanced by heat treatment. In the case of the sonobuoy application, the antenna wire requires that an electrically insulative waterproof coating be applied thereto. These, and other changes and modifications, insofar as they are not departures from the true scope of the invention, are intended to be covered by the claims which follow.

What is claimed is:

1. A collapsible antenna assembly comprising in combination:

a wire antenna having a straight section and a helical spring section integral therewith, the longitudinal axis of said straight section and the coil axis of said helical spring section being oriented transverse to each other, a cylindrical support member for said antenna, said support member having a peripheral circumferential storage slot in proximity to an extremity thereof, a cavity formed in said support member and intersecting with said storage slot, a mounting projection disposed within said cavity, a detent slot in the form of a circular sector, said detent slot being displaced from the periphery of said support member and extending from said extremity of the latter to said storage slot, an erection cam situated on the periphery of said support member and extending within said storage slot, said erection cam forming a portion of the wall defining said detent slot, an assembly slot formed in said last mentioned wall adjacent said erection cam, said helical spring section of said antenna being disposed over said mounting projection such that said straight section assumes a preassembled generally erect position, said straight section entering said detent slot during assembly via said assembly slot, said straight section being rotated about said coil axis of said helical spring section and being wound around said support member within said storage slot, and containment means for selectively restraining said straight section from unwinding from said storage slot and for releasing the same to permit it to reenter said detent slot in an erect operative condition.

2. A collapsible antenna assembly as defined in claim 1 further characterized in that said cavity includes an aperture in the wall structure defining its innermost penetration into said support member, said aperture accommodating the free extremity of said helical spring section, thereby fixing the position of the latter on said mounting projection and providing access for the antenna to the interior of the support member.

3. A collapsible antenna assembly as defined in claim 2 wherein said detent slot includes a distal wall providing a stop for said straight section of said antenna when the latter is fully erect and operational.

4. A collapsible antenna assembly as defined in claim 3 wherein said preassembled generally erect position of said straight section of said antenna includes a predetermined angularity with respect to the longitudinal axis of said support member, such angularity acting as a preload for tending to maintain contact of said straight section with said distal wall of said detent slot.

5. A collapsible antenna assembly as defined in claim 4 further characterized in that the rotation of said straight section about said coil axis of said helical spring section is in a direction to tighten the turns of the coils which comprise said last mentioned section.

6. A collapsible antenna assembly as defined in claim 5 wherein said detent slot includes an entrance opening therein preceding said erection cam as viewed in the direction of motion of said straight section in assuming an erect position after storage.

7. A collapsible antenna assembly as defined in claim 6 wherein said erection cam is configured as a right triangle, the leading edge of said erection cam lying along the hypotenuse and being comprised of a ramp section angled toward said detent slot for assisting the erection of said straight section after release from storage, the trailing edge of said erection cam lying adjacent said assembly slot.

8. A collapsible antenna assembly as defined in claim 7 wherein said straight section of said antenna includes at its free extremity a tang capable of engagement by said containment means.

9. A collapsible antenna assembly as defined in claim 8 wherein said containment means is a pullrod, said support member including a peripheral longitudinal slot having apertured containment sections on respective opposite sides of said storage slot, said pullrod being slidably disposed within said longitudinal slot, an extremity of said pullrod being accommodated by the apertures in said containment sections, said tang of said straight section being engaged by said last mentioned pullrod extremity.

10. A collapsible antenna assembly as defined in claim 9 further characterized in that said support member is comprised of respective separable upper and lower sections, said pullrod having its other extremity coupled to said lower section, the separation of said lower section from said upper section effecting the withdrawal of said pullrod from said apertured containment sections and the release of said straight section of said antenna.

11. A collapsible antenna assembly as defined in claim 10 further including respective grooves in said mounting projection and said erection cam to accommodate said straight section of said antenna as it is wound about said support member within said storage slot.

12. A collapsible antenna assembly as defined in claim 11 wherein said antenna is formed in one piece of spring wire.

* * * * *